US011378041B2

(12) United States Patent
Kato et al.

(10) Patent No.: US 11,378,041 B2
(45) Date of Patent: Jul. 5, 2022

(54) AIR INTAKE DEVICE FOR ENGINE

(71) Applicant: MAZDA MOTOR CORPORATION, Hiroshima (JP)

(72) Inventors: Jiro Kato, Aki-gun (JP); Taketoshi Yamauchi, Aki-gun (JP); Mitsunori Wasada, Aki-gun (JP); Ken Yoshida, Aki-gun (JP); Kenji Takami, Aki-gun (JP); Ryo Yamamoto, Aki-gun (JP); Haruna Yanagida, Aki-gun (JP); Masayoshi Higashio, Aki-gun (JP); Kensuke Ashikaga, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/261,551

(22) PCT Filed: Jun. 27, 2019

(86) PCT No.: PCT/JP2019/025515
§ 371 (c)(1),
(2) Date: Jan. 19, 2021

(87) PCT Pub. No.: WO2020/021952
PCT Pub. Date: Jan. 30, 2020

(65) Prior Publication Data

US 2021/0262420 A1 Aug. 26, 2021

(30) Foreign Application Priority Data

Jul. 24, 2018 (JP) ..... JP2018-138348

(51) Int. Cl.
*F02M 26/10* (2016.01)
*F02M 26/09* (2016.01)
(Continued)

(52) U.S. Cl.
CPC ..... *F02M 26/10* (2016.02); *F02B 37/162* (2019.05); *F02M 26/02* (2016.02); *F02M 26/03* (2016.02);
(Continued)

(58) Field of Classification Search
CPC ..... F02B 37/162
See application file for complete search history.

(56) References Cited

U.S. PATENT DOCUMENTS 5,333,456 A * 8/1994 Bollinger ..... F02M 26/05 60/605.2
6,138,651 A * 10/2000 Mori ..... F02M 26/19 123/568.17
(Continued)

FOREIGN PATENT DOCUMENTS

FR 2847946 A1 * 6/2004 ..... F02M 26/19
FR 2847946 A1 6/2004
(Continued)

*Primary Examiner* — Kevin R Steckbauer
(74) *Attorney, Agent, or Firm* — Alleman Hall Creasman & Tuttle LLP

(57) ABSTRACT

An exhaust gas recirculation (EGR) passage is connected with an intake passage (a bypass passage bypassing a supercharger) of an engine. The EGR passage includes, in a position close to a connection port to the intake passage, an expanding portion in which a passage cross-sectional area expands and which lowers a flow speed of EGR gas so as to reduce an uneven flow, in the connection port, of the EGR gas flowing into the intake passage.

14 Claims, 8 Drawing Sheets

(51) Int. Cl.

| | |
|---|---|
| ***F02M 26/19*** | (2016.01) |
| ***F02M 26/21*** | (2016.01) |
| ***F02M 26/67*** | (2016.01) |
| ***F02B 37/16*** | (2006.01) |
| ***F02M 26/44*** | (2016.01) |
| ***F02M 26/04*** | (2016.01) |
| ***F02M 26/03*** | (2016.01) |
| ***F02M 26/70*** | (2016.01) |
| ***F02M 26/66*** | (2016.01) |
| ***F02M 26/02*** | (2016.01) |
| ***F02M 26/17*** | (2016.01) |

(52) U.S. Cl.

CPC ..... *F02M 26/04* (2016.02); *F02M 26/09* (2016.02); *F02M 26/17* (2016.02); *F02M 26/19* (2016.02); *F02M 26/21* (2016.02); *F02M 26/44* (2016.02); *F02M 26/66* (2016.02); *F02M 26/67* (2016.02); *F02M 26/70* (2016.02)

(56) References Cited

U.S. PATENT DOCUMENTS

| | | | | |
|---|---|---|---|---|
| 7,624,722 | B2 * | 12/2009 | Matthews | F02M 26/19 123/568.17 |
| 9,422,877 | B2 * | 8/2016 | Sorge | F02D 41/0047 |
| 10,094,337 | B2 * | 10/2018 | Massard | F02D 9/08 |
| 10,100,784 | B2 * | 10/2018 | Gerbig | B01D 53/0407 |
| 10,385,810 | B2 * | 8/2019 | Matsushima | F02M 26/02 |
| 11,118,546 | B2 * | 9/2021 | Yoshida | F02M 26/17 |
| 2009/0165757 | A1 * | 7/2009 | Matthews | F02M 26/19 123/568.17 |
| 2014/0318514 | A1 * | 10/2014 | Pursifull | F02D 41/005 123/568.29 |

FOREIGN PATENT DOCUMENTS

| | | | | | |
|---|---|---|---|---|---|
| JP | 2003322039 | A | | 11/2003 | |
| JP | 2013060921 | A | | 4/2013 | |
| JP | 2013108479 | A | | 6/2013 | |
| JP | 2015124755 | A | | 7/2015 | |
| JP | 2016121540 | A | * | 7/2016 | F02M 26/19 |
| JP | 2016121540 | A | | 7/2016 | |

* cited by examiner

CONVENTIONAL ART

AIR INTAKE DEVICE FOR ENGINE

TECHNICAL FIELD

The present invention relates to an air intake device for an engine.

BACKGROUND ART

Patent Literature 1 discloses that a supercharger raising a pressure of air introduced into engine combustion chambers is arranged in an intake passage of a multi-cylinder engine, a bypass passage bypassing the supercharger is provided in the intake passage, a bypass valve adjusting an opening of the bypass passage is provided in the bypass passage, and an exhaust gas recirculation (EGR) valve is provided in an EGR passage connecting the intake passage with an exhaust passage.

CITATION LIST

Patent Literature

Patent Literature 1: Japanese Patent Laid-Open No. 2003-322039

SUMMARY OF INVENTION

Technical Problem

In a case of a multi-cylinder engine causing EGR gas to return, when EGR amounts become non-uniform among cylinders, stable combustion may not be performed in all of the cylinders. The inventor has investigated non-uniformity of the EGR amounts among the cylinders. Then, it has been found that one factor in the non-uniformity is that the EGR gas returned to an intake passage and fresh air flowing through the intake passage are not sufficiently mixed together before those are distributed from the intake passage to each of the cylinders.

In FIG. 7, a reference numeral 25 denotes a bypass passage configuring an intake passage, and a reference numeral 69 denotes a connection port of an EGR passage in which an EGR valve 62 is provided. In this example, the fresh air flows on an upper side in the bypass passage 25 as indicated by broken lines, and the EGR gas flows from the connection port 69 mainly into a lower side in the bypass passage 25 as indicated by solid lines. In the simplest of terms, the fresh air and the EGR gas thus flow to a downstream side of the bypass passage 25 in two separate layers. This can be understood from the EGR concentration distribution in each portion in the bypass passage 25, which is illustrated in FIG. 8.

In FIG. 8, on an immediately downstream side of the connection port 69, an inside of the bypass passage 25 is split into a region A in which a concentration related to the EGR gas is high and a region B in which the concentration is low. Toward the downstream side of the bypass passage 25, the high concentration region A and the low concentration region B decrease, and a medium concentration region C expands. However, although the bypass passage 25 branches to branch portions 25*a* and 25*b* and is connected with a surge tank 75, even in the branch portion. 25*a*, the high concentration region A and the low concentration region B remain. That is, it can be understood that the fresh air and the EGR gas flow into the surge tank 75 without being completely mixed together. Thus, non-uniformity likely to occur to the EGR amounts among cylinders.

An important problem is that in accordance with an operation state of an engine (for example, an engine speed), not only an uneven state of a fresh air flow in the intake passage (the bypass passage in the example of FIGS. 7 and 8) changes, but also an uneven state of a flow in a case where the EGR gas flows from the connection port 69 into the intake passage changes. As a result, in accordance with the operation state of the engine, the non-uniformity of the EGR amounts among the cylinders becomes different, and it thus becomes difficult to secure combustion stability.

Accordingly, an object of the present invention is to efficiently mix fresh air and EGR gas.

Solution to Problem

To solve the above problem, in the present invention, an expanding portion in which a passage cross-sectional area expands and which lowers a flow speed of EGR gas flowing into an intake passage is provided in a position close to a connection port of an EGR passage to the intake passage.

An air intake device for an engine disclosed herein, includes:

an intake passage leading intake air to combustion chambers of a multi-cylinder engine;

an exhaust passage discharging exhaust gas from the combustion chambers; and an EGR passage connecting the intake passage with the exhaust passage and returning a portion of the exhaust gas as EGR gas from the exhaust passage to the intake passage, and is characterized in that the EGR passage includes, in a position close to a connection port to the intake passage, an expanding portion in which a passage cross-sectional area expands and which lowers a flow speed of the EGR gas so as to reduce an uneven flow, in the connection port, of the EGR gas flowing, into the intake passage.

Accordingly, the flow speed of the EGR gas in the EGR passage is lowered in a position close to the connection port to the intake passage, and the uneven flow of the EGR gas in the connection port is thereby reduced. That is, the extent of the uneven flow becomes low, and the EGR gas easily flows into the intake passage along a whole circumference of the connection port. As a result, even if a flow of fresh air flowing through the intake passage is slightly uneven, the EGR gas is likely to collide with the fresh air, that is, mixing of the fresh air and the EGR gas easily progresses, and non-uniformity of EGR amounts among the cylinders is reduced. Consequently, an advantage in securing combustion stability of the engine is obtained.

In one embodiment, the EGR passage includes a passage portion extending toward the connection port and in a direction intersecting with the intake passage and intersecting with a center line of the connection port and a direction-changing portion starting from the passage portion, changing a direction to the direction of the center line of the connection port, and reaching the connection port, and the expanding portion is provided in the direction-changing portion.

In a case where the direction-changing portion in which a flow direction of the EGR gas changes is present in a position close to the connection port to the intake passage in the EGR passage, unevenness of the flow of the EGR gas is likely to occur, but the expanding portion is provided in the direction-changing portion, and the unevenness is thereby reduced.

In one embodiment, the intake passage includes a supercharging passage in which a supercharger raising a pressure of the intake air introduced into the combustion chambers is arranged and a bypass passage connecting an upstream side with a downstream side of the supercharger and leading the intake air to the combustion chambers while bypassing the supercharger, and the EGR passage is connected with the bypass passage of the intake passage.

When the fresh air is led from the bypass passage to the combustion chambers without going through the supercharger, mixing of the fresh air and the EGR gas by the supercharger is not expected. However, even in this case, as described above, the expanding portion is provided in the EGR passage, mixing of the fresh air and the EGR gas thereby easily progresses in the bypass passage, and non-uniformity of the EGR amounts among the cylinders is reduced.

In one embodiment, an EGR valve of a poppet type is included, the EGR valve being provided to the connection port and adjusting a returning amount of the EGR gas, and a valve shaft of the EGR valve passes through the bypass passage. Accordingly, in a portion around the valve shaft, collision between the fresh air flowing while bypassing the valve shaft and the EGR gas flowing along the valve shaft is caused, and mixing of the fresh air and the EGR gas thereby easily progresses.

In one embodiment, a bypass valve is included, the bypass valve being provided in the bypass passage and adjusting a supercharging pressure of the intake air by the supercharger, and the connection port opens on an upstream side of the bypass valve in the bypass passage. Accordingly, because the flows of the fresh air and the EGR gas are disturbed when those pass through the bypass valve, mixing of the fresh air and the EGR gas easily progresses.

In one embodiment, the expanding portion includes a divergent portion in which a passage cross-sectional area gradually expands toward the connection port. Accordingly, when the EGR gas passes through the divergent portion, the EGR gas is easily spread in the whole expanding portion while its flow speed is gradually lowered toward the connection port. Thus, unevenness of the flow of the EGR gas can be reduced without excessively disturbing the flow of the EGR gas.

Advantageous Effects of Invention

In the present invention, an EGR passage includes, in a position close to a connection port to an intake passage, an expanding portion in which a passage cross-sectional area expands and which lowers a flow speed of EGR gas so as to reduce an uneven flow of the EGR gas in the connection port. Thus, the EGR gas flowing into the intake passage is likely to collide with fresh air, and consequently, mixing of the fresh air and the EGR gas easily progresses. As a result, non-uniformity of EGR amounts among cylinders reduced, and an advantage in securing combustion stability of an engine is thus obtained.

DESCRIPTION OF EMBODIMENT

A form for carrying out the present invention will hereinafter be described based on drawings. The description of a preferable embodiment is substantially only exemplification and is not intended to restrict the present invention, applications thereof, or uses thereof.

<General Configuration of Engine>

Figure 1:
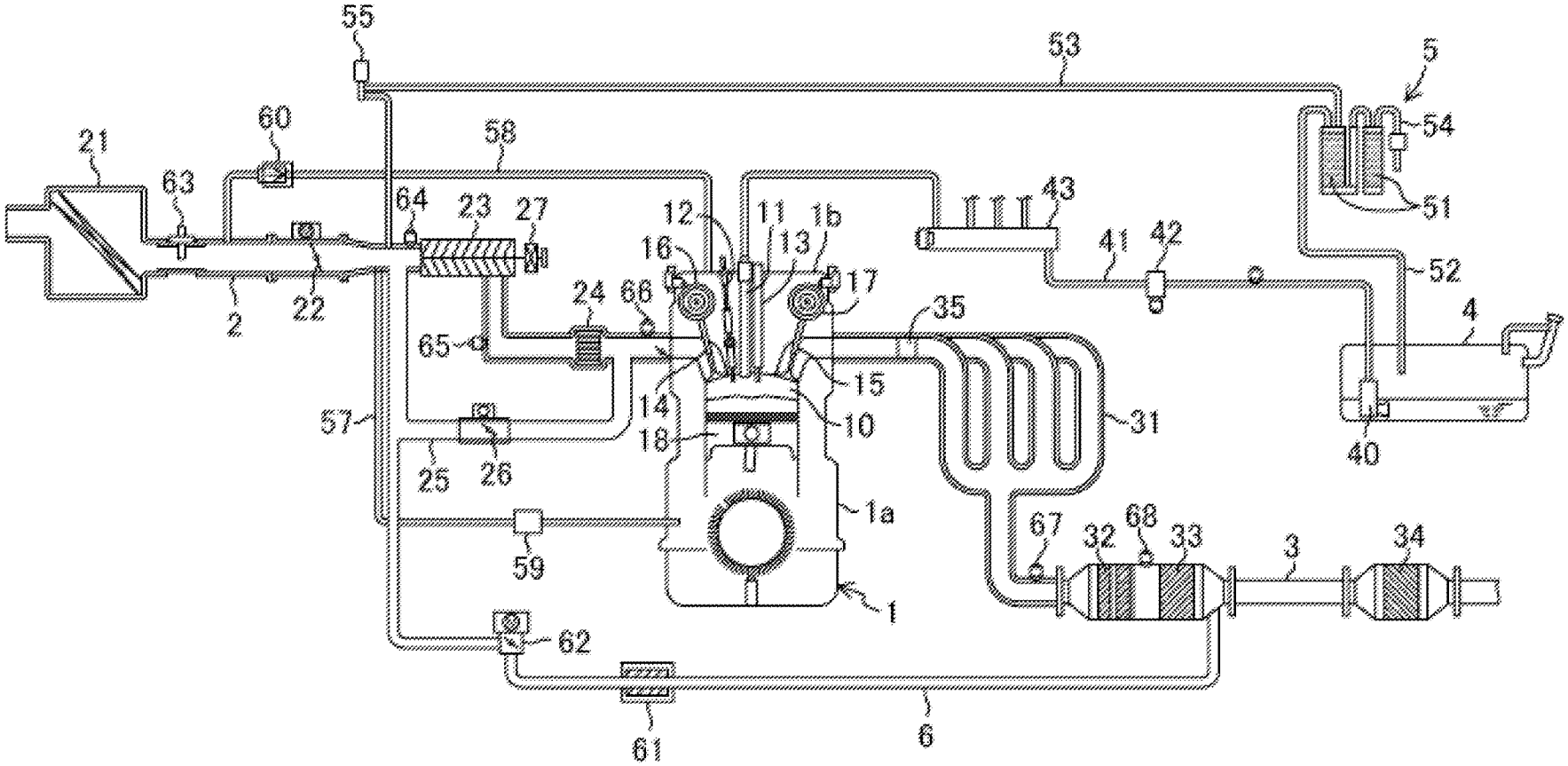
FIG. 1 is a configuration diagram of an engine system.

In a vehicle-installed engine system illustrated in FIG. 1, a reference numeral 1 denotes an engine, a reference numeral 2 denotes an intake passage of the engine 1, a reference numeral 3 denotes an exhaust passage of the engine 1, and a reference numeral 4 denotes a fuel tank. The system includes an evaporated fuel treatment device 5 leading evaporated fuel produced in the fuel tank 4 to the intake passage of the engine 1.

The engine 1 is an in-line four-cylinder compression ignition engine. FIG. 1 illustrates only one cylinder of the engine 1. The engine 1 described in this embodiment is merely one example, and in the present invention, types and specific configurations of an engine are not limited. The engine 1 includes a direct injection fuel injection valve 11, a spark plug 12, and a cylinder inner pressure sensor 13, which face a combustion chamber 10 of each cylinder. In the engine 1, an intake valve 14 is provided to an intake port, and an exhaust valve 15 is provide to an exhaust port. The engine 1 includes variable valve mechanisms 16 and 17 for respectively driving the intake valve 14 and the exhaust valve 15 to open and close. A reference numeral 18 denotes a piston of the engine 1.

The intake passage 2 includes an intake manifold (not illustrated) for introducing intake air into the combustion chambers 10 of the cylinders in a branched manner. In the intake passage 2, in order from an upstream side to a downstream side, an air cleaner 21, a throttle valve 22 adjusting an introduction amount of fresh air into the combustion chambers 10, a supercharger raising a pressure of gas introduced into the combustion chambers 10, and an intercooler 24 cooling the gas introduced into the combustion chambers 10 by a supercharger 3 are disposed. Further, in the intake passage 2, a bypass passage 25 connecting an upstream side of the supercharger 23 with a downstream side of the intercooler 24 is provided on a downstream side of the throttle valve 22.

That is, the intake passage 2 includes a supercharging passage in which the supercharger 23 raising a pressure of the intake air introduced into the combustion chambers 10 is arranged and the bypass passage 25 leading the intake air to the combustion chambers 10 while bypassing the supercharger 23. In the bypass passage 25, a bypass valve 26 is provided which adjusts a flow amount of gas flowing through the bypass passage 25.

The supercharger 23 of this embodiment is a mechanical supercharger driven via a belt by a crankshaft of the engine 1. A supercharger 44 of a mechanical type may be of a Roots type, a Lysholm type, a vane type, or a centrifugal type, for example. Note that instead of a mechanical supercharger, an electric supercharger, or a turbocharger driven by exhaust energy may be employed.

The supercharger 23 is connected with the crankshaft of the engine 1 via an electromagnetic clutch 27. Transmission and disconnection of motive power from the engine 1 to the supercharger are performed by connection and disconnection of the electromagnetic clutch 27.

When the electromagnetic clutch 27 is set to a disconnected state (when the supercharger 23 is not acting), the bypass valve 26 is fully opened. Accordingly, the intake air is introduced into the combustion chambers 10 of the engine 1 by the bypass passage 25 without going through the supercharger 23. That is, the engine 1 is operated in a naturally aspirated (non-supercharging) state.

When the electromagnetic clutch 27 is set to a connected state (when the supercharger 23 is acting), a supercharging pressure is adjusted to a desired pressure by control of the bypass valve 26. That is, when the bypass valve 26 is opened, a portion of the intake air passing through the supercharger 23 goes through the bypass passage 25 and reversely flows to an upstream side of the supercharger 23. Because a reverse flow amount of the intake air changes in accordance with the opening of the bypass valve 26, the supercharging pressure of the intake air introduced into the combustion chambers 10 can be controlled.

The exhaust passage 3 includes an exhaust manifold 31 for gathering and discharging exhaust gas of the cylinders. In the exhaust passage 3 on a downstream side of the exhaust manifold 31, two catalytic converters purifying the exhaust gas are provided. The catalytic converter on an upstream side has a three-way catalyst 32 and a GPF (gasoline particulate filter) 33 and is disposed in an engine room of a vehicle. The catalytic converter on a downstream side has a three-way catalyst 34 and is disposed on the outside of the engine room. An exhaust shutter valve 35 is provided to each branch pipe of the exhaust manifold 31.

The intake passage 2 and the exhaust passage 3 are connected together by an exhaust gas recirculation (EGR) passage 6 returning a portion of the exhaust gas as EGR gas to the intake passage 2. An upstream end of the EGR passage 6 is connected with a portion in the exhaust passage 3 between the upstream catalytic converter and the downstream catalytic converter. A downstream end of the EGR passage 6 is connected with an intermediate portion of the bypass passage 25 so as to supply the EGR gas to a portion in the intake passage 2 on a downstream side of the throttle valve 22 and on an upstream side of the supercharger 23. The EGR gas enters an upstream side of the supercharger 23 in the intake passage 2 without going through the bypass valve 26 of the bypass passage 25. In the EGR passage 6, an EGR cooler 61 cooling the EGR gas and an EGR valve 62 adjusting a returning amount of the EGR gas are disposed.

Note that although FIG. 1 depicts the EGR valve 62 as provided in an intermediate portion of the EGR passage 6, in this embodiment, the EGR valve 62 provided to a connection port of the EGR passage 6 to the bypass passage 25.

The fuel tank 4 is connected with the fuel injection valves 11 by a fuel supply passage 41. An upstream end of the fuel supply passage 41 is connected with a fuel strainer 40 in the fuel tank 4. In the fuel supply passage 41, a fuel pump 42 and a common rail 43 are provided. The fuel pump 42 pumps fuel into the common rail 43. The common rail 43 stores the fuel pumped from the fuel pump 42 at a high fuel pressure. When the fuel injection valve 11 is opened, the fuel stored in the common rail 43 is injected from an injection hole of the fuel injection valve 11 into the combustion chamber 10.

The evaporated fuel treatment device 5 includes canisters 51 causing the evaporated fuel produced in the fuel tank 4 to be adsorbed onto activated carbon. The fuel tank 4 and the canisters are connected together by a tank-side passage 52, and the canisters 51 and the intake passage 2 are connected together by a purge passage 53. An outside air introduction passage 54 having an atmospheric opening is connected with the canisters 51. A purge valve 55 opening and closing the purge passage 53 is provided to the purge passage 53. The purge valve 55 opens when a predetermined purge condition is satisfied, for example, in a state where an air-fuel ratio of the engine 1 can properly be controlled by control of a fuel injection amount by the fuel injection valves 11.

When a negative pressure is generated on a downstream side of the throttle valve 22 in the intake passage 2 in a state where the purge valve 55 is open, the evaporated fuel collected in the canisters 51 is purged. That is, together with air introduced from the outside air introduction passage 54 into the canisters 51, the evaporated fuel is purged from the purge passage 53 to a downstream side of the throttle valve 22 in an intake passage 21. The purged evaporated fuel is supplied to the combustion chambers of the engine 1 through the supercharger 23 or the bypass passage 25 and is combusted together with the fuel supplied from the fuel injection valves 11.

The engine system includes a blowby gas returning device. The blowby gas returning device includes a blowby passage 57 and an air introduction passage 58. One end of the blowby passage 57 is connected with a crankcase 1*a* of the engine 1, and the other end is connected with a portion of the intake passage 2 on a downstream side of the throttle valve 22 and on an upstream side of the supercharger 23. A PCV (positive crankcase ventilation) valve 59 is provided to the blowby passage 57.

The PCV valve 59 allows only gas in a direction from the crankcase 1*a* side to the intake passage 2 side to pass through. In a negative pressure state where the pressure on the downstream side of the throttle valve 22 in the intake passage 2 is lower than the pressure of the crankcase 1*a*, the opening of the PCV valve 59 changes in accordance with the extent of the negative pressure. That is, a blowby gas flow amount from the crankcase 1*a* to the intake passage 2 is adjusted to an appropriate amount in accordance with the negative pressure.

One end of the air introduction passage 58 is connected with the crankcase 1*a* via a cylinder head 1*b* of the engine 1, and the other end is connected with a portion of the intake passage 2 between the air cleaner 21 and the throttle valve 22. In the air introduction passage 58, a check valve 60 is provided which allows only air in a direction from the intake passage 2 side to the crankcase 1*a* side to pass through.

When blowby gas is released from the crankcase 1*a* to the intake passage 2 through the blowby passage 57, air filtered by the air cleaner 21 is introduced from the air introduction passage 58 into the crankcase 1*a*. Accordingly, the crankcase 1*a* is ventilated.

In the intake passage 2, an air flow sensor 63 detecting an intake air amount, a pressure sensor 64 detecting an intake pressure on a downstream side of the throttle valve 22 (an upstream side of the supercharger 23), a temperature sensor 65 detecting the temperature of the intake air ejected from the supercharger 23, and a pressure sensor 66 detecting the intake pressure on a downstream side of the intercooler 24 are provided, the sensors being for controlling the engine 1. In the exhaust passage 3, a linear $O_2$ sensor 67 detecting an oxygen concentration in the exhaust gas on an upstream side of the three-way catalyst 32 and a lambda $O_2$ sensor 68 detecting the oxygen concentration in the exhaust gas on a downstream side of the three-way catalyst 32 are provided.

<Structures of Engine System Configuration Elements>

Figure 2:
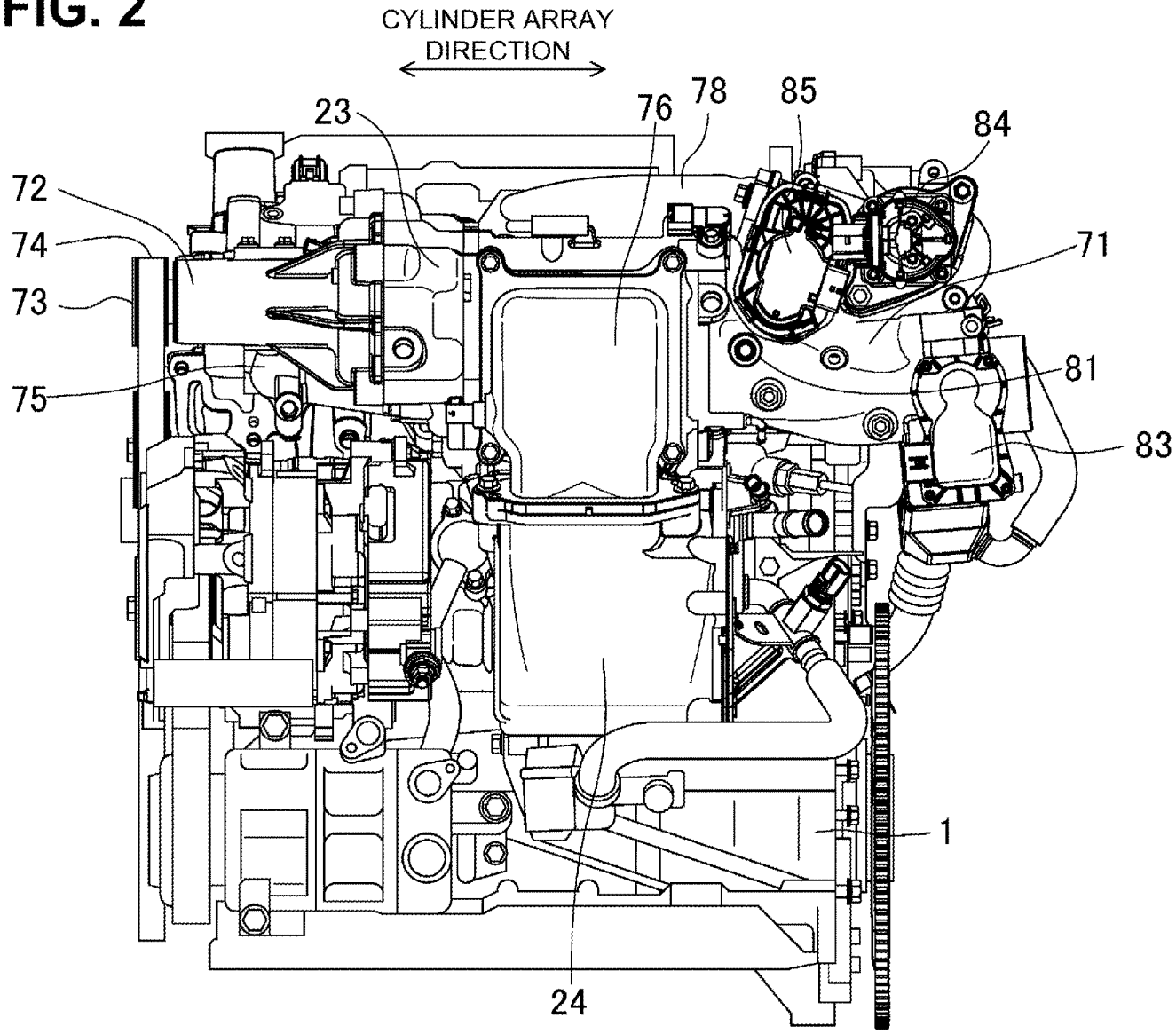
FIG. 2 is a front view of an engine.

As illustrated in FIG. 2, the supercharger 23 is provided in a state where an axis extends in a cylinder array direction in a portion above the engine 1. An upstream intake pipe 71 configuring the intake passage 2 extending in the cylinder array direction is coupled with this supercharger 23. A drive part housing 72 of the supercharger 23 protrudes toward the opposite side, in the supercharger 23, to the upstream intake pipe 71. The electromagnetic clutch 27 and a driving shaft for driving the supercharger 23 by the crankshaft of the engine 1 are housed in this drive part housing 72. A transmission belt 74 is wound around a pulley 73 coupled with the driving shaft.

An upstream end of an ejection duct 76 for leading pressurized intake air to a surge tank (reference sign 75 in FIG. 4) extending in the cylinder array direction is connected with a side surface of the supercharger 23. The ejection duct 76 extends to a lower side of the supercharger 23, and a lower end thereof is connected with the intercooler 24 arranged below the supercharger 23.

Figure 3:
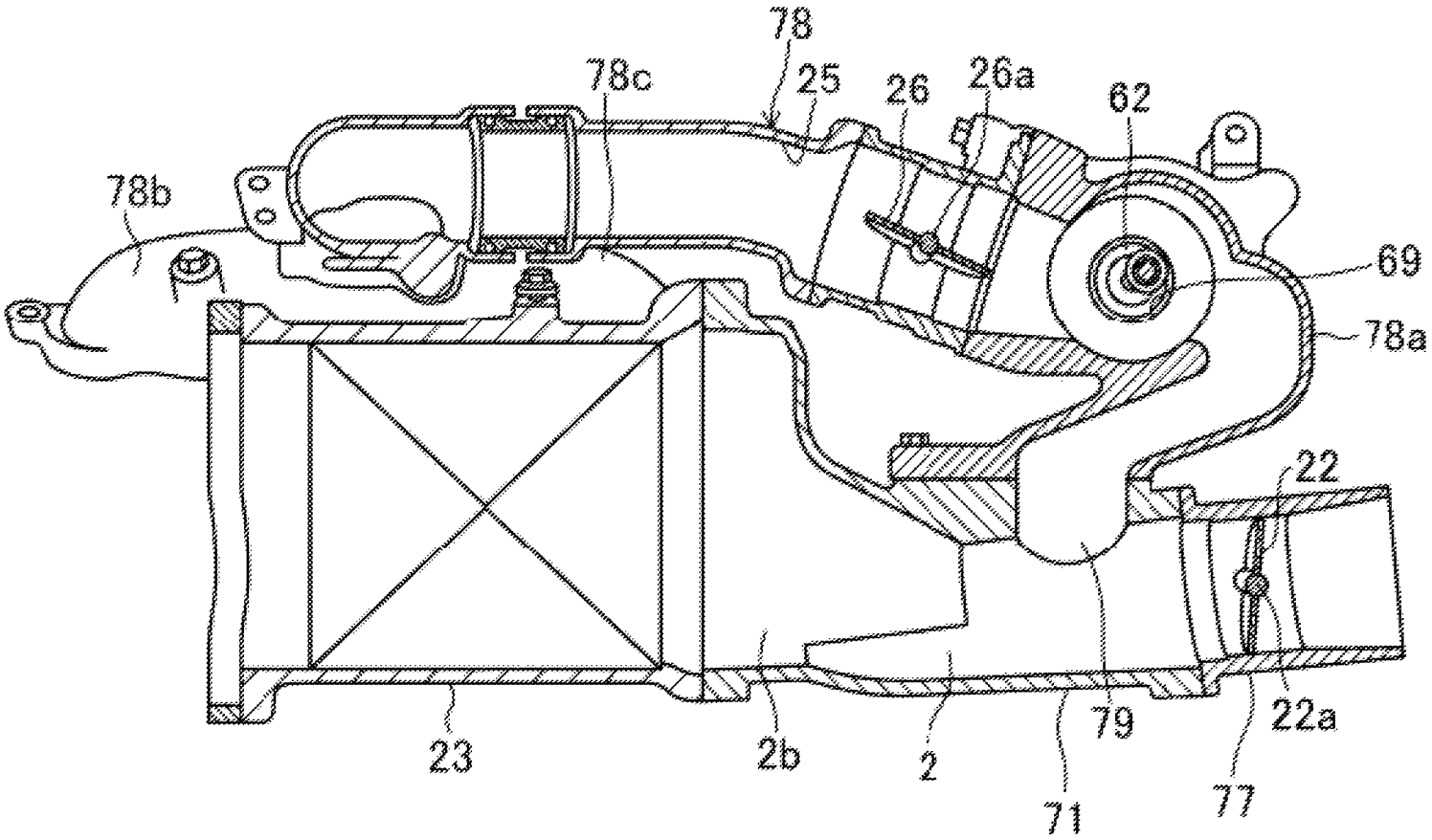
FIG. 3 is a cross-sectional view of an intake system of the engine.

As illustrated in FIG. 3, a throttle body 77 including the throttle valve 22 is provided to an upstream end portion of the upstream intake pipe 71. The throttle valve 22 is a butterfly valve, and a valve shaft 22*a* thereof is horizontally provided. On a downstream side of the throttle body 77 (an upstream side of the supercharger 23), a bypass pipe 78 forming the bypass passage 25 obliquely rises from an upper surface of the upstream intake pipe 71 toward an upstream side of the upstream intake pipe 71. That is, on a downstream side of the throttle valve 22, a connection port 79 of the bypass passage 25 opens in a top portion of an upper half circumferential portion of the intake passage 2 formed with the upstream intake pipe 71.

On a downstream side of the connection port 79 of the bypass passage 25, the upstream intake pipe 71 forms a passage expanding portion 2*b* in which a passage cross-sectional area expands toward the supercharger 3, and an expanding end thereof is connected with the supercharger 3.

The bypass pipe 78 has a folded portion 78*a* that is continuous with the above-described oblique rising portion and is folded, in a curved manner, toward a downstream side of the upstream intake pipe 71. The bypass pipe 78 is continuous with the folded portion 78*a* and extends toward a central side of the surge tank 75 in the cylinder array direction above the supercharger 23. An EGR pipe (not illustrated in FIG. 3) forming the EGR passage 6 is connected with a downstream side of the folded portion 78*a* in the bypass pipe 78, and the EGR valve 62 is provided to a connection port 69 of the EGR passage 6 to the bypass passage 25. The connection port 69 opens in a side surface of the bypass passage 25. The bypass pipe 78 branches to a first branch pipe 78*b* extending in one direction of the cylinder array direction and a second branch pipe 78*c* extending in the other direction of the cylinder array direction.

Figure 4:
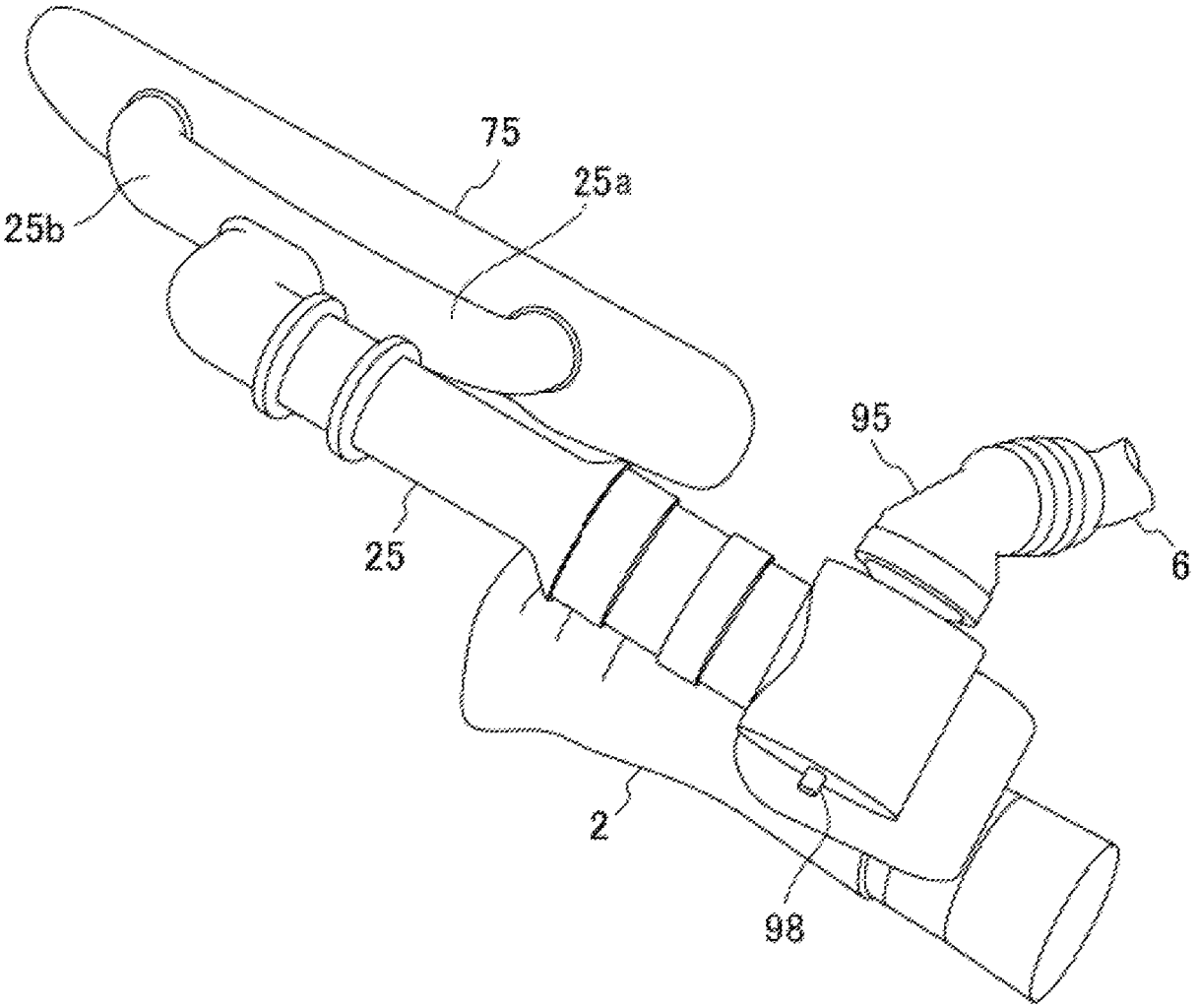
FIG. 4 is a perspective view or the intake system of the engine.

As illustrated in FIG. 4, branch portions 25*a* and 25*b* of the bypass passage 25 respectively formed with both of the branch pipes 78*b* and 78*c* are connected with the surge tank 75.

As illustrated in FIG. 3, the bypass valve 26 is provided in the bypass pipe 78 on a downstream side of the EGR valve 62. That is, the connection port 69 of the EGR passage 6 opens in the bypass passage 25 on an upstream side of the bypass valve 26. The bypass valve 26 is a butterfly valve, and a valve shaft 26*a* thereof is horizontally provided.

Figure 5:
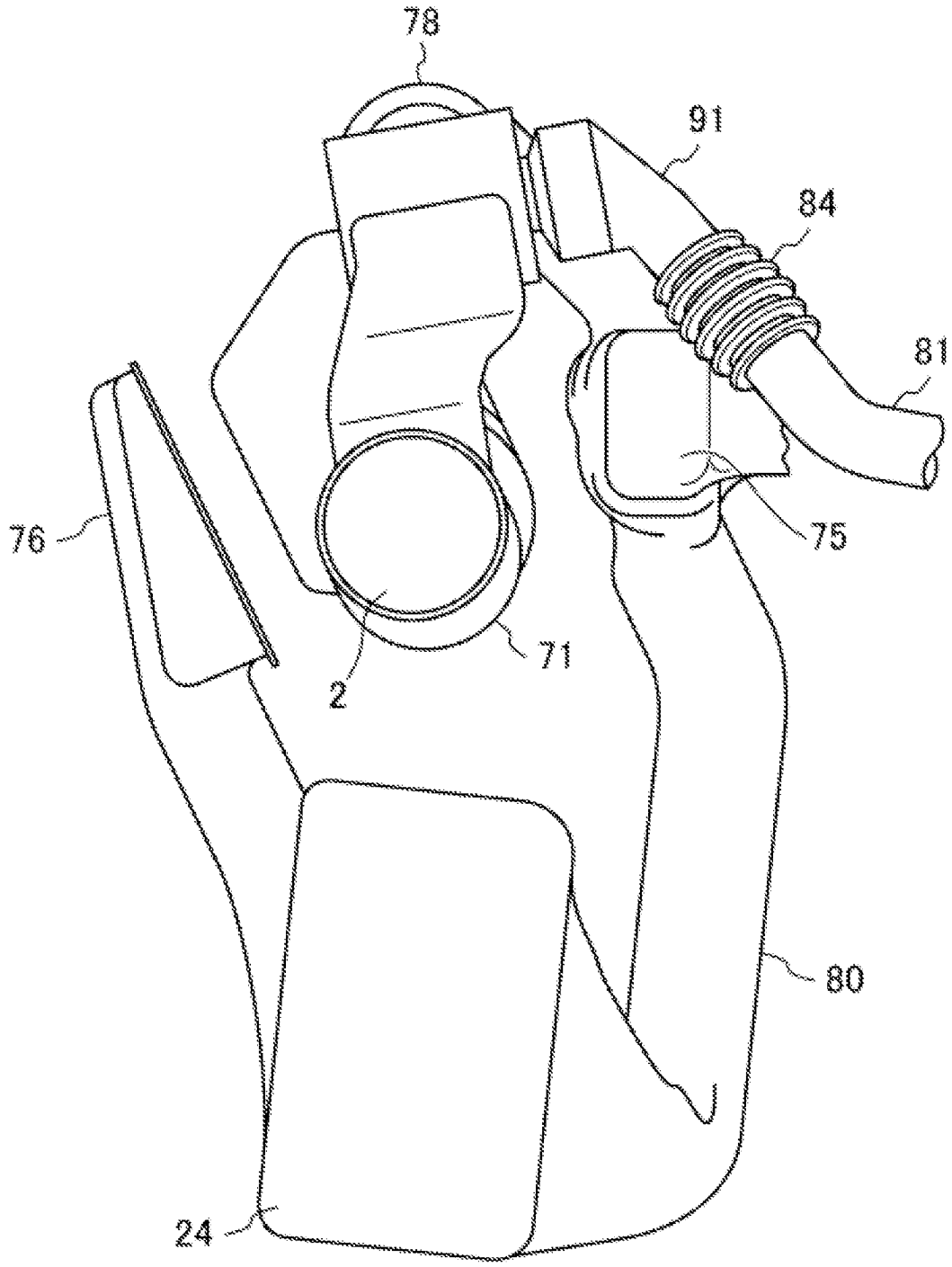
FIG. 5 is a front view of the intake system of the engine.

As illustrated in FIG. 5, an intake air introduction passage 80 is integrally provided to the surge tank 75. The intake air introduction passage 80 extends to a lower side of the surge tank 75 and is connected with the intercooler 24. Further, as illustrated in FIG. 5, an EGR pipe 81 extending from the exhaust passage 3 includes a rising portion 91 rising from a lower position than the bypass pipe 78 toward a side surface of the bypass pipe 78, an upper end portion of the rising portion 91 is connected with the side surface of the bypass pipe 78.

Figure 6:
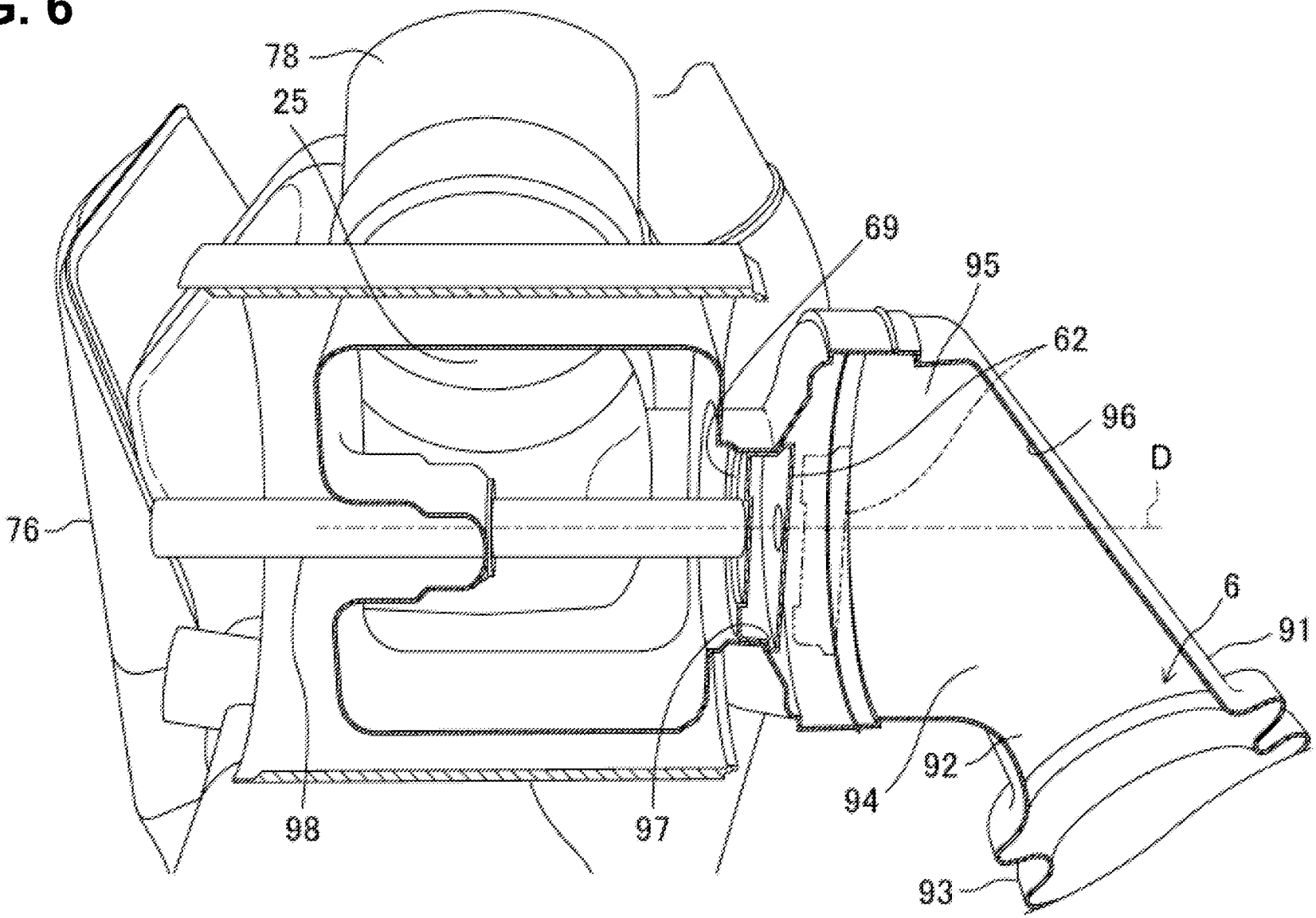
FIG. 6 is a cross sectional view of a connection portion between a bypass passage and an EGR passage.

As illustrated in FIG. 6, the rising portion 91 of the EGR pipe 81 forms a passage portion 92 extending toward the connection port 69 of the EGR passage 6 in the bypass passage 25 and in a direction intersecting with the bypass passage 25 and intersecting with a center line D of the connection port 69. In a middle portion of this rising portion 91, a flexible portion (bellows portion) 93 is provided which absorbs displacement between an upstream portion and a downstream portion of the middle portion. The upper end portion of the rising portion 91 forms a direction-changing portion 94 in a position close to the connection port 69, the direction-changing portion 94 being continuous with the passage portion 92, changing a direction to the direction of the center line D of the connection port 69, and reaching the connection port 69.

An expanding portion 95 in which a passage cross-sectional area expands compared to the passage portion 92 (a passage portion with a circular cross section on a downstream side of the flexible portion 84) is formed in the direction-changing portion 94. The expanding portion 95 includes a divergent portion 96 in which the passage cross-sectional area gradually expands from a downstream end of the passage portion 92 toward the connection port 69. The passage cross-sectional area of the expanding portion 95 is larger than the passage cross-sectional area of the connection port 69. The direction-changing portion 94 includes a portion in which the passage cross-sectional area shrinks and which is continuous with the expanding portion 95 and reaches the connection port 69, and a valve seat 97 of the EGR valve 62 opening and closing the connection port 69 is formed in the shrinking portion.

The EGR valve 62 of a poppet type, a valve shaft 98 thereof passes through the bypass passage 25 and extends in the direction of the center line 8) of the connection port 69. That is, the valve shaft 98 crosses an inside of the bypass passage 25 in the direction of the center line D of the connection port 69. The valve shaft 98 moves forward and backward by being driven by a solenoid-type EGR valve drive part 85 illustrated in FIG. 2, and the connection port 69 opens by movement of the EGR valve 62 to the expanding portion 95 side.

Note that in FIG. 2, a reference numeral 83 denotes a drive part of the throttle valve 22, and a reference numeral 84 denotes a drive part of the bypass valve 26.

<Mixing of EGR Gas and Fresh Air>

In the above embodiment, in a case where the supercharger 23 is not acting, the case being illustrated in FIG. 3, the fresh air passing through the throttle valve 22 of the intake passage 2 flows into the bypass passage 25 through the connection port 79. The fresh air goes through a portion, in which the EGR valve 62 is provided, and a portion, in which the bypass valve 26 is provided, of the bypass passage 25 and is introduced from the branch portions 25*a* and 25*b* illustrated in FIG. 4 into the surge tank 75.

As illustrated in FIG. 6, when the EGR valve 62 opens (a valve open state is indicated by the chain lines), the EGR gas is led upward through the passage portion 92 of the EGR passage 6. The flow direction of the EGR gas is changed from an upward direction to a lateral direction in the direction-changing portion 94 and flows from a portion around the EGR valve 62 into the bypass passage 25 through the connection port 69.

Figure 7:
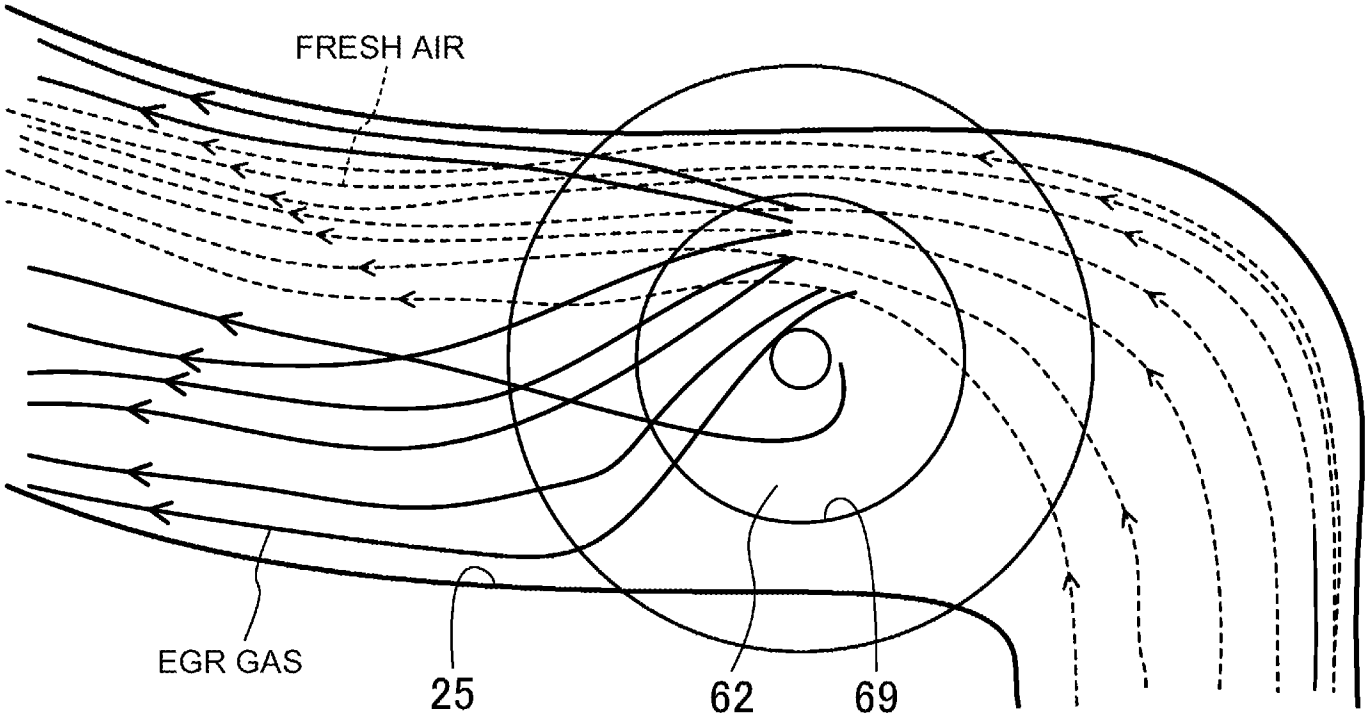
FIG. 7 is a side view illustrating flows of fresh air and EGR gas.
Figure 8:
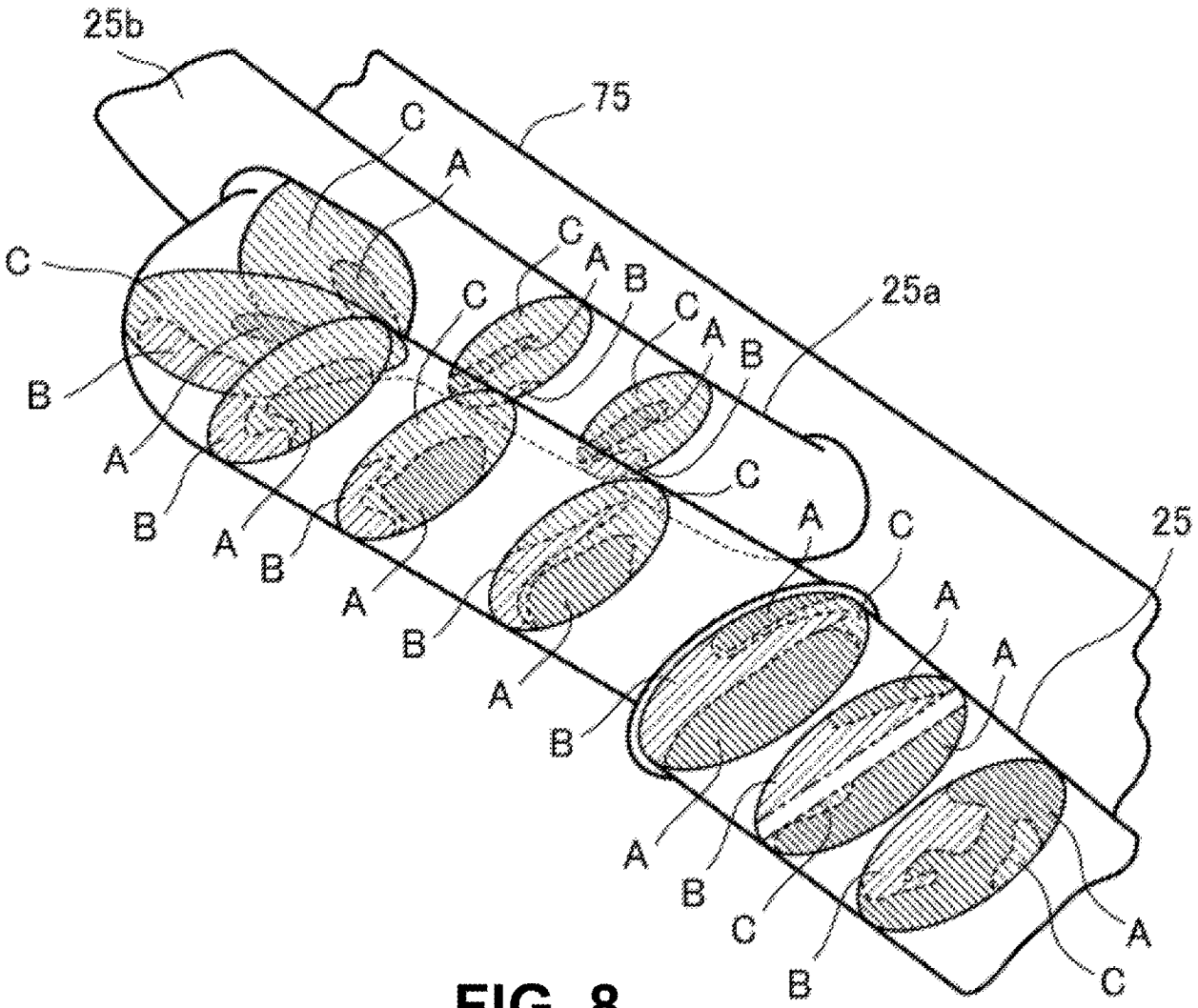
FIG. 8 CONVENTIONAL ART
FIG. 8 is a diagram illustrating an EGR concentration distribution in each portion in the bypass passage.

As described above, when the flow direction of the EGR gas changes in the direction-changing portion 94, in related art, in accordance with an operation state of the engine, that is, in accordance with the flow speed of the EGR gas, unevenness occurs to a flow of the EGR gas in the direction-changing portion 94. For example, as the ow speed becomes higher, the EGR gas is more likely to flow unevenly along an upper half circumferential side of the direction-changing portion 94 and to flow from an upper side of the EGR valve 62 into the bypass passage 25 through the connection port 69. In this case, because the EGR gas moves obliquely downward from the upper side of the EGR valve 62 toward the connection port 69 and as a result flows into a lower half circumferential side of the bypass passage 25, as illustrated in FIG. 7 and FIG. 8, the fresh air and the EGR gas are likely to flow in two separate layers in the bypass passage 25.

On the other hand, in the above embodiment, because the expanding portion 95 of the passage cross-sectional area is formed in the direction-changing portion 94, the flow speed of the EGR gas flowing through the passage portion 92 is lowered in the expanding, portion 95. This lowering of the flow speed reduces unevenness of the EGR gas in the direction-changing portion 94, and the EGR gas flows from the portion around the EGR valve 62 into the bypass passage 25 while comparatively evenly going through the connection port 69. As a result, in the bypass passage 25, the EGR gas is likely to contact with the flow of the fresh air from a lateral side, and the fresh air and the EGR gas are thus easily mixed together.

Furthermore, in the above embodiment, because an upstream side of the expanding portion 95 is formed as the divergent portion 96, when the EGR gas passes through the divergent portion 96, the EGR gas is easily spread in the whole expanding portion while its flow speed is gradually lowered. Thus, this is advantageous to reduction of unevenness of the flow of the EGR gas.

Further, in the above embodiment, because the valve shaft 98 of the EGR valve 62 crosses the bypass passage 25, the fresh air moving while bypassing the valve shaft 98 collides with the EGR gas flowing along the valve shaft 98, and the fresh air and the EGR gas are easily mixed together. In addition, because when the fresh air and the EGR gas pass through the bypass valve 26, the flows of those are disturbed by the bypass valve 26, mixing easily progresses.

As described above, unevenness of the flow of the EGR gas passing through the connection port 69 is reduced, and mixing of the fresh air and the EGR gas in the bypass passage 25 easily progresses. As a result, non-uniformity of EGR amounts among cylinders is reduced, and an advantage in securing combustion stability of the engine is consequently obtained.

Note that the EGR valve 62 of the above embodiment is of a poppet type; however, a butterfly type EGR valve can also reduce unevenness of the flow of the EGR gas passing through the connection port 69 by providing an expanding portion as described above in the vicinity of the connection port on a downstream side of the EGR valve.

REFERENCE CHARACTERS LIST

1 engine
2 intake passage
3 exhaust passage
6 EGR passage
10 combustion chamber
23 supercharger
25 bypass passage
26 bypass valve
62 EGR valve
69 connection port
92 passage portion
94 direction-changing portion
95 expanding portion
96 divergent portion
98 valve shaft

The invention claimed is:

1. An air intake device for an engine, the air intake device comprising:

an intake passage leading intake air to combustion chambers of a multi-cylinder engine;

an exhaust passage discharging exhaust gas from the combustion chambers;

an exhaust gas recirculation (EGR) passage connecting the intake passage with the exhaust passage and returning a portion of the exhaust gas as EGR gas from the exhaust passage to the intake passage; and an EGR valve of a poppet type provided to a connection port to the intake passage and configured to adjust a returning amount of the EGR gas, wherein the EGR passage includes, in a position close to the connection port, an expanding portion in which a passage cross-sectional area expands and which lowers a flow speed of the EGR gas so as to reduce an uneven flow, in the connection port, of the EGR gas flowing into the intake passage, the EGR passage further includes a passage portion extending toward the connection port and in a direction intersecting with the intake passage and intersecting with a center line of the connection port, the intake passage includes a folded portion folded in a curved manner and a bypass passage leading the intake air to the combustion chambers, the connection port of the EGR passage is positioned near and downstream of the folded portion, and a valve shaft of the EGR valve passes through the bypass passage.

2. The air intake device for an engine according to claim 1, wherein the EGR passage includes a direction-changing portion being continuous with the passage portion, changing a direction to the direction of the center line of the connection port, and reaching the connection port, and the expanding portion is provided in the direction-changing portion.

3. The air intake device for an engine according to claim 2, wherein the intake passage includes a supercharging passage in which a supercharger raising a pressure of the intake air introduced into the combustion chambers is arranged, the bypass passage connects an upstream side with a downstream side of the supercharger and leads the intake air to the combustion chambers while bypassing the supercharger, and the EGR passage is connected with the bypass passage of the intake passage.

4. The air intake device for an engine according to claim 1, wherein the intake passage includes a supercharging passage in which a supercharger raising a pressure of the intake air introduced into the combustion chambers is arranged, the bypass passage connects an upstream side with a downstream side of the supercharger and leads the intake air to the combustion chambers while bypassing the supercharger, and the EGR passage is connected with the bypass passage of the intake passage.

5. The air intake device for an engine according to claim 1, wherein the expanding portion includes a divergent portion in which a passage cross-sectional area gradually expands toward the connection port.

6. The air intake device for an engine according to claim 2, wherein the expanding portion includes a divergent portion in which a passage cross-sectional area gradually expands toward the connection port.

7. The air intake device for an engine according to claim 3, further comprising:

a bypass valve of a butterfly type, the bypass valve being provided in the bypass passage and adjusting a supercharging pressure of the intake air by the supercharger, wherein the connection port opens on an upstream side of the bypass valve in the bypass passage.

8. The air intake device for an engine according to claim 3, wherein the expanding portion includes a divergent portion in which a passage cross-sectional area gradually expands toward the connection port.

9. The air intake device for an engine according to claim 4, further comprising:

a bypass valve of a butterfly type, the bypass valve being provided in the bypass passage and adjusting a supercharging pressure of the intake air by the supercharger, wherein the connection port opens on an upstream side of the bypass valve in the bypass passage.

10. The air intake device for an engine according to claim 4, wherein the expanding portion includes a divergent portion in which a passage cross-sectional area gradually expands toward the connection port.

11. The air intake device for an engine according to claim 7, wherein the expanding portion includes a divergent portion in which a passage cross-sectional area gradually expands toward the connection port.

12. The air intake device for an engine according to claim 9, wherein the expanding portion includes a divergent portion in which a passage cross-sectional area gradually expands toward the connection port.

13. The air intake device for an engine according to claim 1, wherein the folded portion is folded as viewed in a direction of the center line of the connection port.

14. The air intake device for an engine according to claim 13, wherein the EGR passage includes a direction-changing portion being continuous with the passage portion, changing a direction to the direction of the center line of the connection port, and reaching the connection port, and the direction-changing portion of the EGR passage is formed so that an upstream side of the EGR passage is directed toward the folded portion as viewed in an extending direction of the intake passage.

* * * * *